US010465527B2

(12) United States Patent
Weber et al.

(10) Patent No.: US 10,465,527 B2
(45) Date of Patent: Nov. 5, 2019

(54) SUPPORT FOR A MULTI-WALL CORE

(71) Applicant: General Electric Company, Schenectady, NY (US)

(72) Inventors: David Wayne Weber, Simpsonville, SC (US); Gregory Thomas Foster, Greer, SC (US); Robert Peter Hanet, Canton, MI (US)

(73) Assignee: General Electric Company, Schenectady, NY (US)

( * ) Notice: Subject to any disclaimer, the term of this patent is extended or adjusted under 35 U.S.C. 154(b) by 243 days.

(21) Appl. No.: 15/354,221

(22) Filed: Nov. 17, 2016

(65) Prior Publication Data

US 2018/0135430 A1 May 17, 2018

(51) Int. Cl.

| | |
|---|---|
| ***B22C 9/10*** | (2006.01) |
| ***B22C 21/14*** | (2006.01) |
| ***F01D 5/18*** | (2006.01) |
| ***F01D 25/12*** | (2006.01) |
| ***B22C 9/12*** | (2006.01) |

(52) U.S. Cl.

CPC ..... *F01D 5/187* (2013.01); *B22C 9/108* (2013.01); *B22C 9/12* (2013.01); *B22C 21/14* (2013.01); *F01D 25/12* (2013.01); *F05D 2220/30* (2013.01); *F05D 2230/60* (2013.01)

(58) Field of Classification Search

CPC .. B22C 9/10; B22C 9/108; B22C 9/12; B22C 21/14

USPC ..... 164/369, 370, 397, 398, 399, 400

See application file for complete search history.

(56) References Cited

U.S. PATENT DOCUMENTS

| | | | | |
|---|---|---|---|---|
| 2,791,386 | A * | 5/1957 | Kastan | B64C 3/18 244/123.4 |
| 3,210,997 | A | 10/1965 | Karlby et al. | |
| 4,252,068 | A | 2/1981 | Nolan | |
| 5,046,866 | A | 9/1991 | Mulcahy | |
| 5,296,308 | A | 3/1994 | Caccavale et al. | |
| 5,820,774 | A | 10/1998 | Dietrich | |
| 5,853,044 | A | 12/1998 | Wheaton et al. | |
| 6,347,660 | B1 | 2/2002 | Sikkenga et al. | |
| 6,761,534 | B1 | 7/2004 | Willett | |
| 6,806,703 | B2 | 10/2004 | Le Bihan et al. | |
| 7,550,968 | B2 | 6/2009 | Joubert et al. | |
| 2004/0094287 | A1 | 5/2004 | Wang | |
| 2005/0247429 | A1 | 11/2005 | Turkington et al. | |
| 2010/0129217 | A1 | 5/2010 | Cherolis et al. | |
| 2013/0167647 | A1 | 7/2013 | Bailey et al. | |

(Continued)

FOREIGN PATENT DOCUMENTS

| | | |
|---|---|---|
| EP | 1 559 500 A1 | 8/2005 |
| GB | 2 346 340 A | 8/2000 |
| WO | 2007008571 A1 | 1/2007 |

OTHER PUBLICATIONS

Extended European Search Report and Opinion issued in connection with corresponding EP Application No. 17200751.0 dated Feb. 20, 2018.

(Continued)

*Primary Examiner* — Kevin P Kerns

(74) *Attorney, Agent, or Firm* — Dale Davis; Hoffman Warnick LLC

(57) ABSTRACT

A core for an airfoil casting, including: a cantilevered core section; and a boss extending from the cantilevered core section to an outer profile of the core.

8 Claims, 12 Drawing Sheets

(56) References Cited

U.S. PATENT DOCUMENTS

| | | | |
|---|---|---|---|
| 2013/0333855 | A1 | 12/2013 | Merrill et al. |
| 2016/0177741 | A1 | 6/2016 | Kirollos et al. |
| 2017/0173672 | A1 | 6/2017 | Foster et al. |

OTHER PUBLICATIONS

Ozarslan, A., et al., Cooling pocket for turbomachine nozzle, GE Co-Pending U.S. Appl. No. 15/376,763, filed Dec. 13, 2016.
Partial European Search Report and Opinion issued in connection with corresponding EP Application No. 16203126.4 dated May 4, 2017.
Extended European Search Report and Opinion issued in connection with corresponding EP Application No. 16203126.4 dated Oct. 20, 2017.
Notice of Allowance and Fee(s) Due dated Mar. 5, 2018 for U.S. Appl. No. 14/977,028, filed Dec. 21, 2015; pp. 9.

* cited by examiner

SUPPORT FOR A MULTI-WALL CORE

BACKGROUND OF THE INVENTION

The disclosure relates generally to turbine systems, and more particularly, to a support for a multiwall core.

Traditional means for providing location and rib wall thickness control for a passage (e.g. a center plenum) of a multiwall or double wall casting have been through the use of bumpers. A bumper is a raised pad on either the center plenum or cooling passages that limits the gap between these two features. Ideally, the bumpers would not touch, but occasionally they do, leaving a hole between the two cavities in the casting process. The number of holes formed from these connections is unknown, leading to uncertainty in the cooling flow distribution in the part.

BRIEF DESCRIPTION OF THE INVENTION

A first aspect of the disclosure provides a core for an airfoil casting, including: a cantilevered core section; and a boss extending from the cantilevered core section to an outer profile of the core.

A second aspect of the disclosure provides a core for a multiwall airfoil casting, including: a cantilevered core section; and a boss extending from the cantilevered core section to an outer profile of the core for controlling a position of the cantilevered core section during a firing process.

A third aspect of the disclosure provides a method for forming a core for an airfoil casting, including: positioning a first side of a core on a first setter block, the core comprising a cantilevered core section and a boss extending from the cantilevered core section to an outer profile of the core; closing a second setter block against a second side of the core; and heating the core, wherein the boss controls the position of the cantilevered core section in a cavity formed by the first setter block and the second setter block during the heating of the core.

The illustrative aspects of the present disclosure solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawing that depicts various embodiments of the disclosure.

It is noted that the drawings are not necessarily to scale. The drawings are intended to depict only typical aspects of the disclosure, and therefore should not be considered as limiting the scope of the disclosure. In the drawings, like numbering represents like elements.

DETAILED DESCRIPTION OF THE INVENTION

As indicated above, the disclosure relates generally to turbine systems, and more particularly, to a support for a multiwall core.

According to embodiments, at least one boss is used to provide positional and thickness control for various portions of a core in the casting process of a multiwall airfoil during a firing process. Such bosses may be used to support, for example, center plenum sections or opposing sections of a multiwall core. Such opposing sections may include, for example, sections that form opposing passages (e.g., cantilevered passages without substantial support at the root and tip of the passages) in a multiwall airfoil.

Figure 1:
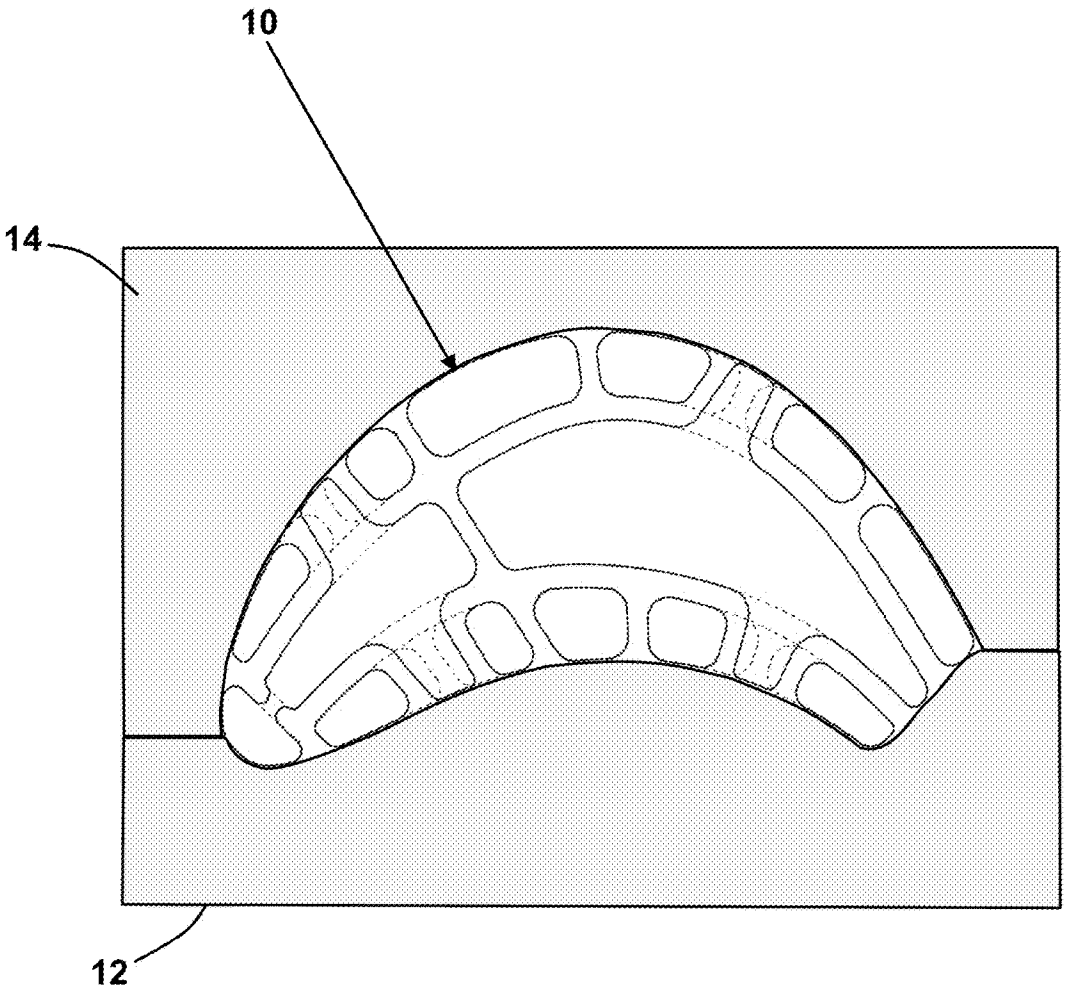
FIG. 1 is a cross-sectional view of a core disposed between upper and lower fire setter blocks according to embodiments.
Figure 2:
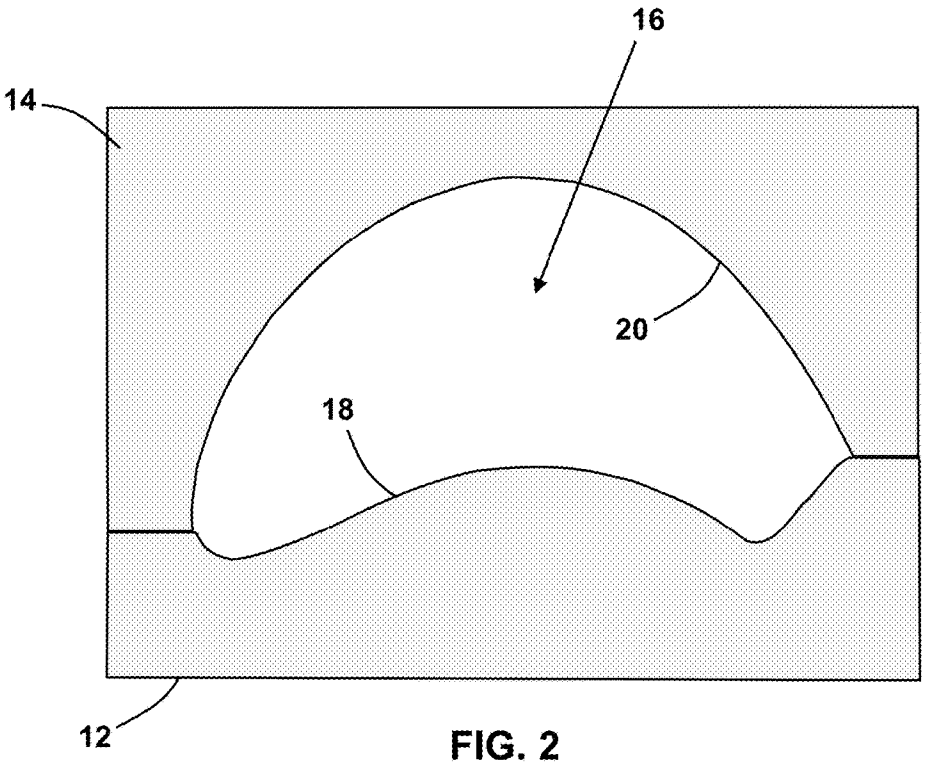
FIG. 2 depicts a cavity formed by the upper and lower fire setter blocks of FIG. 1 according to embodiments.

A setter fire step is often employed to control and correct the dimensions of a core (e.g., a ceramic core) used in the casting process of a multiwall airfoil (e.g., a multiwall turbine airfoil). As depicted in FIG. 1, this step may involve, for example, positioning the core 10 in a lower (pressure side) setter block 12, closing an upper (suction side) setter block 14 against the core 10 and the lower setter block 12, and performing a firing process. The lower and upper setter blocks 12, 14 form a cavity 16 (FIG. 2) defining the desired shape of the core 10. During the firing process, the core 10 heats up and softens. The weight of the upper setter block 14 against the softened core 10 conforms the core 10 to the shape of the cavity 16. As shown in FIG. 2, the cavity 16 is defined by the inner surfaces 18, 20 of the lower and upper setter blocks 12, 14.

Figure 3:
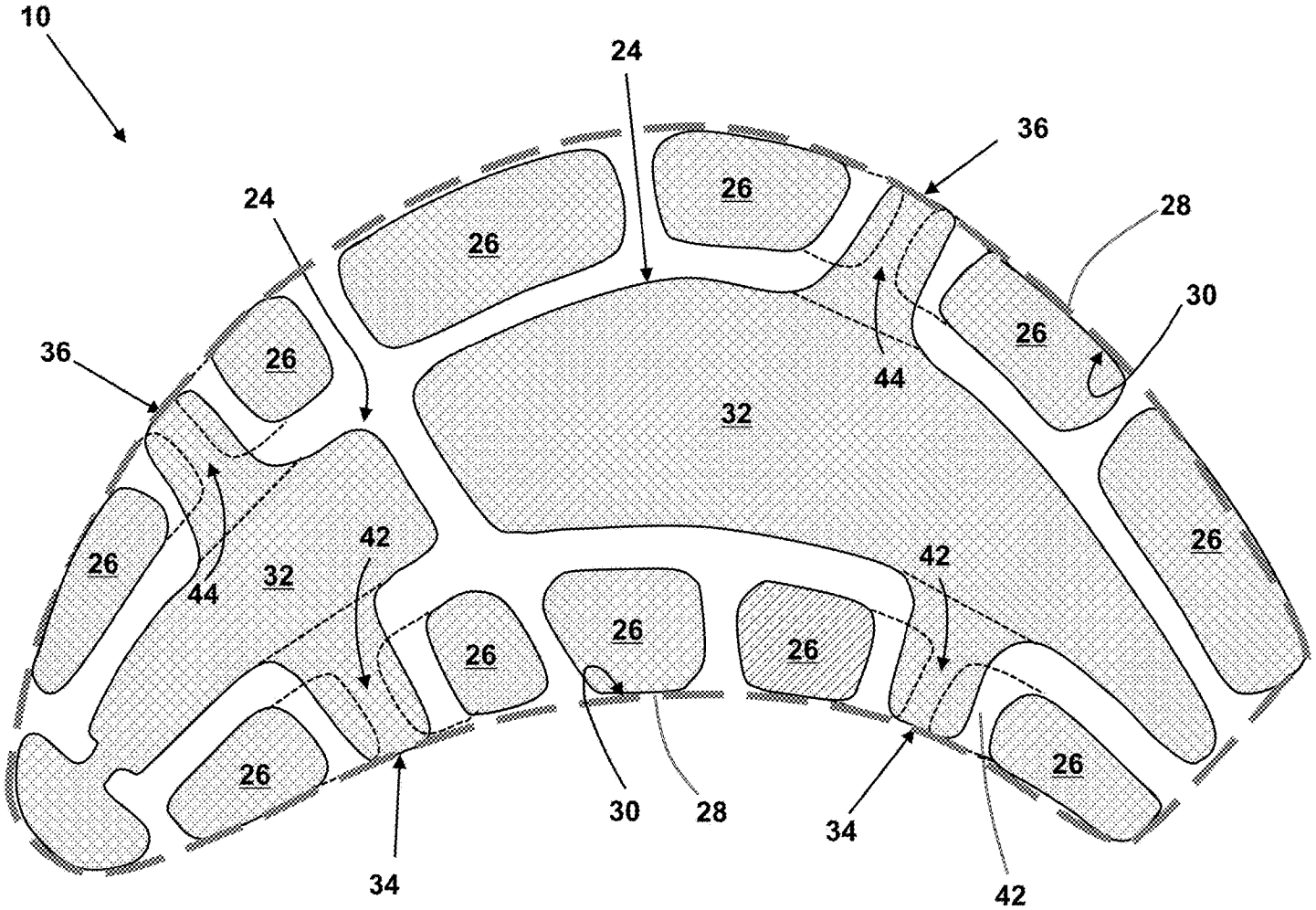
FIG. 3 is a first cross-sectional view of a core according to embodiments.
Figure 8:
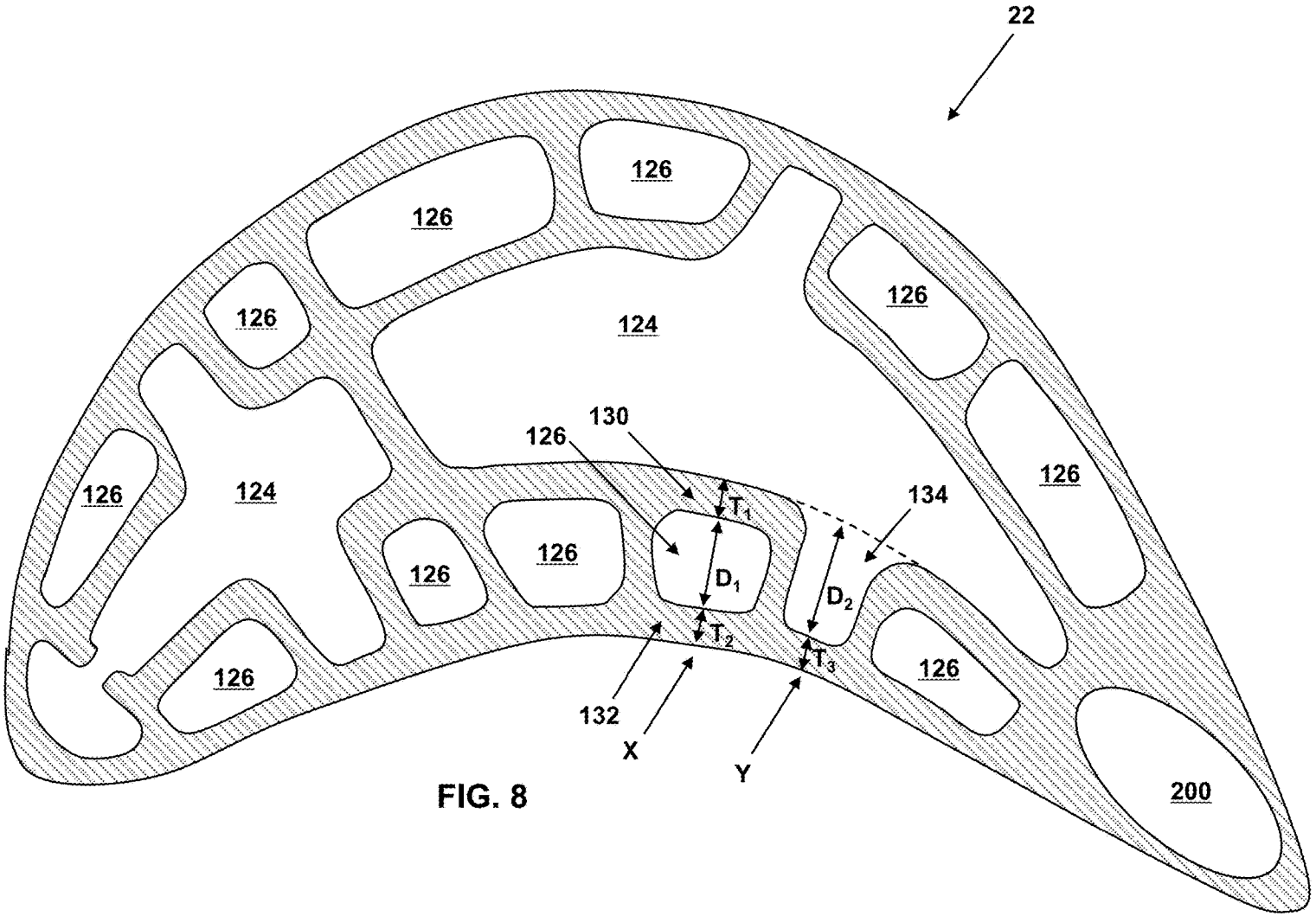
FIG. 8 is a first cross-sectional view of a multiwall airfoil formed using the core of FIGS. 3 and 6 according to embodiments.
Figure 9:
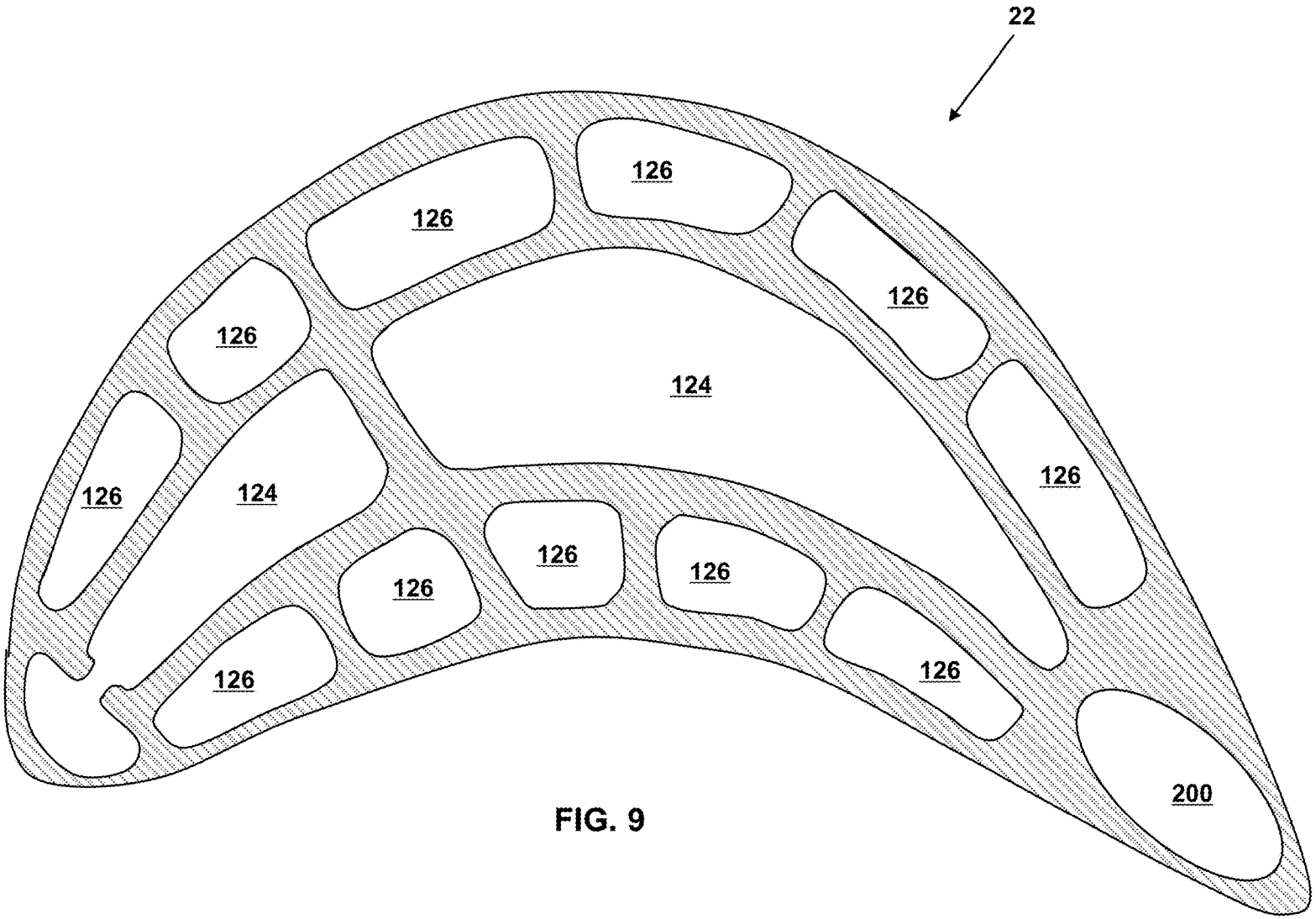
FIG. 9 is a second cross-sectional view of a multiwall airfoil formed using the core of FIGS. 3 and 6 according to embodiments.
Figure 10:
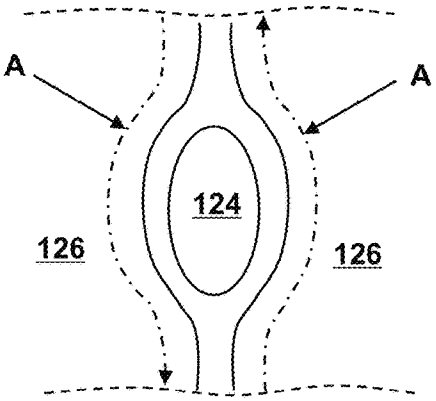
FIGS. 10 and 11 are plan views of a portion of a multiwall airfoil formed using the core of FIGS. 3 and 6 according to embodiments.
Figure 11:
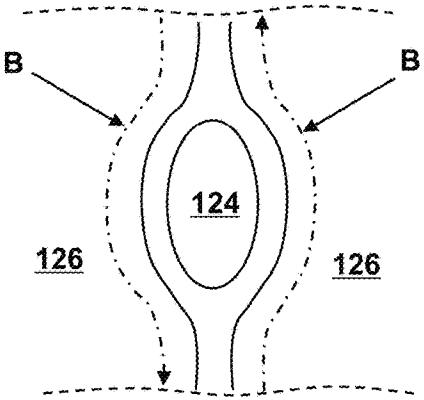

The core 10 is used during the casting process of a multiwall airfoil 22 (see, e.g., FIGS. 8 and 9). As depicted in detail in FIG. 3, the core 10 may include a plurality of center plenum sections 24, which are configured to form center plenums 124 (FIGS. 8-11) of the multiwall airfoil 22, and a plurality of outer passage sections 26, which are configured to form outer cooling passages 126 (FIGS. 8-11) of the multiwall airfoil 22. The core 10 has an outer surface 28 that is at least partially defined by the exterior surfaces 30 of the outer passage sections 26.

Each center plenum section 24 includes a center section 32, at least one lower boss 34, and at least one upper boss 36. The lower and upper bosses 34, 36 extend outwardly from the center section 32 of the center plenum section 24 to, but not beyond, the outer surface 28 of the core 10. Each lower boss 34 is located on a "pressure" or concave side of the core 10, corresponding to the pressure side of a multiwall airfoil 22 (FIGS. 8, 9) formed using the core 10. Similarly, each upper boss 36 is located on the "suction" or convex side of the core 10, corresponding to a suction side of a multiwall airfoil 22 (FIGS. 8, 9) formed using the core 10. The lower and upper bosses 34, 36 are configured to control the position, and prevent the movement of, the center plenum sections 24 in the cavity 16 formed by the lower setter block 12 and upper setter block 14 during firing. As shown in FIGS. 3-5 and 7, each lower and upper boss 34, 36 may extend outwardly from the center plenum section 24 between a pair of the outer passage sections 26.

Figure 7:
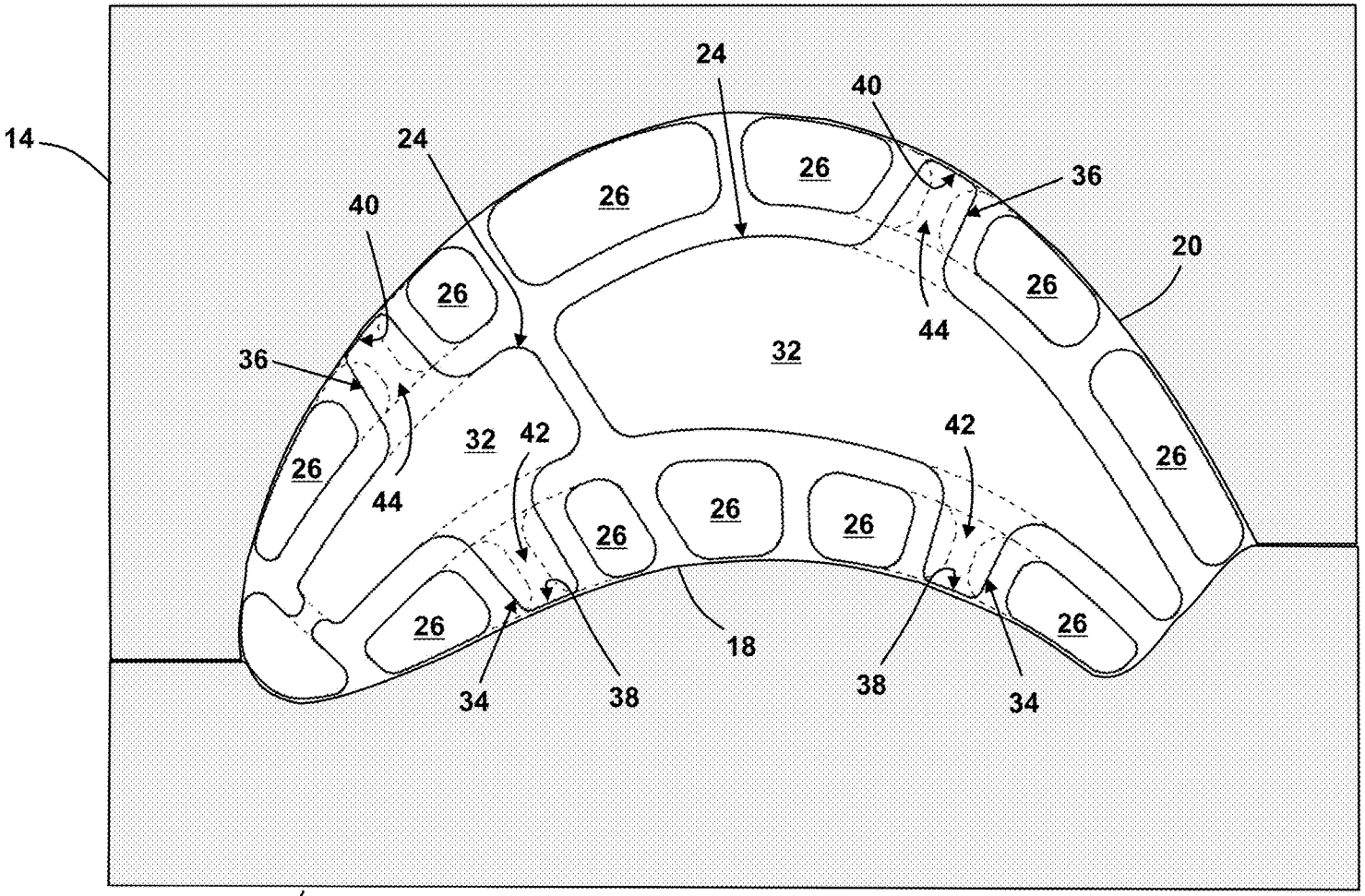
FIG. 7 is a cross-sectional view of the core of FIG. 3, disposed between upper and lower fire setter blocks according to embodiments.

The lower and upper bosses 34, 36 are configured to be securely engaged by the inner surfaces 18, 20 of the lower and upper setter blocks 12, 14. To provide a secure engagement, as shown in FIG. 7, an outer contact surface 38 of each lower boss 34 has a contour that matches the contour of the inner surface 18 of the lower setter block 12 at the corresponding contact area. Similarly, the outer contact surface 40 of each upper boss 36 has a contour that matches the contour of the inner surface 20 of the upper setter block 14 at the corresponding contact area. Advantageously, unlike the related art, the lower bosses 34 and upper bosses 36 do not contact the outer passage sections 26, thereby preventing the formation of holes between the center plenums 124 and outer cooling passages 126 (FIGS. 8-11) of a multiwall airfoil 22 formed using the core 10. In each of the additional embodiments disclosed below, each boss may have a surface contour that is configured to match the contour of a corresponding inner surface of the lower/upper setter block.

Figure 4:
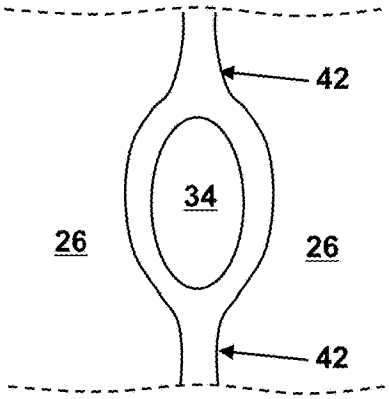
FIG. 4 is a plan view of a lower boss and adjacent outer passage sections of the core of FIG. 3 according to embodiments.
Figure 5:
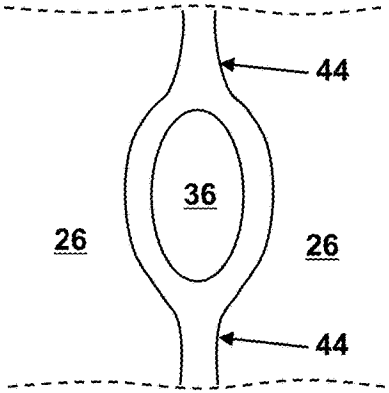
FIG. 5 is a plan view of an upper boss and adjacent outer passage sections of the core of FIG. 3 according to embodiments.

A plan view of a lower boss 34 and adjacent outer passage sections 26 is depicted in FIG. 4. A plan view of an upper boss 36 and adjacent outer passage sections 26 is depicted in FIG. 5. The bosses in other embodiments described below may have a similar configuration.

Figure 6:
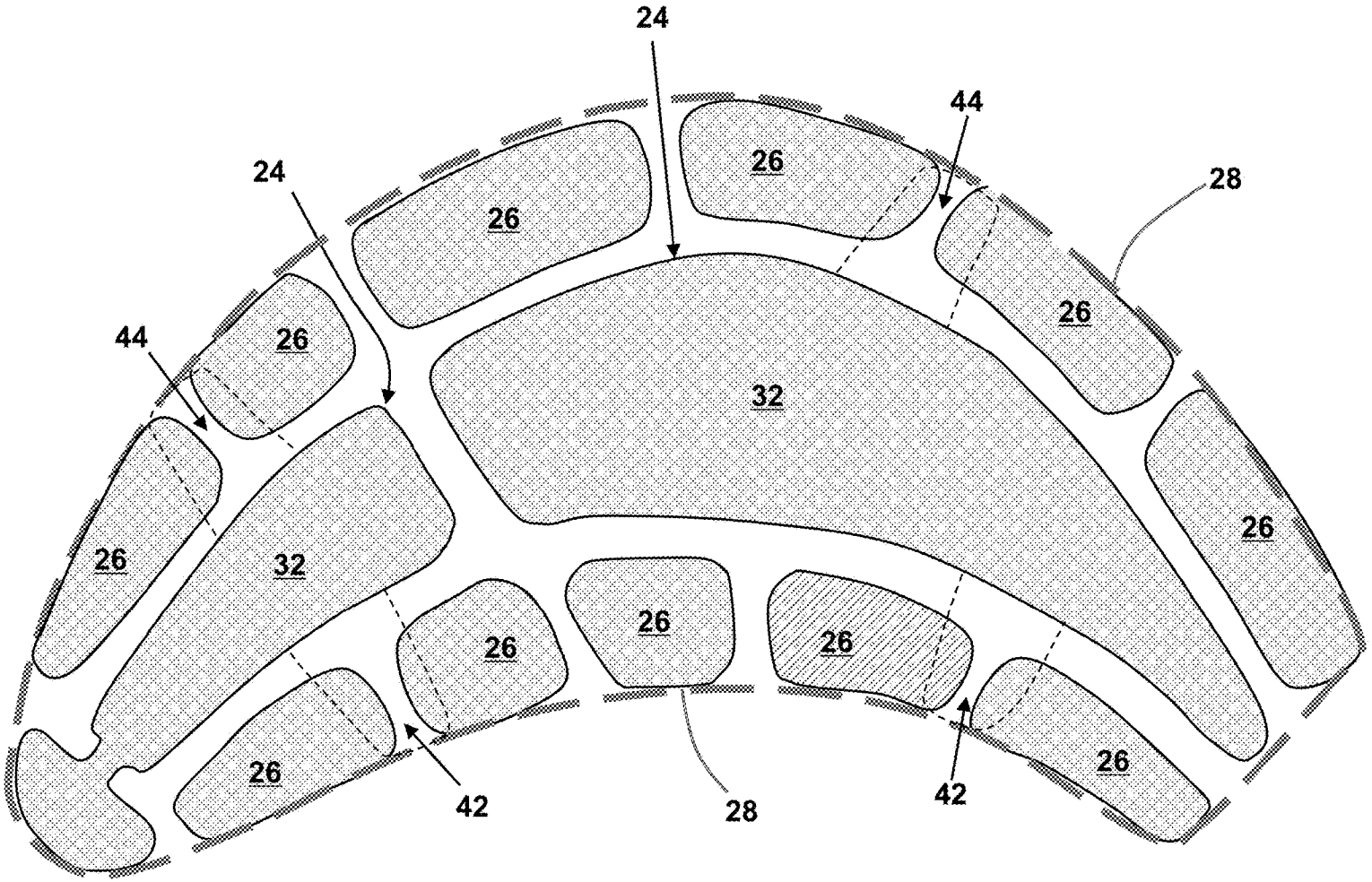
FIG. 6 is a second cross-sectional view of the core according to embodiments.

As shown in FIG. 4, each lower boss 34 may have a substantially elliptical configuration. A channel 42 (see also FIGS. 3 and 7 (in phantom) and FIG. 6) diverges around a first end of the lower boss 34 and converges at a second end of the lower boss 34. To limit turbulence and pressure loss of air (represented by arrows A in FIG. 10) flowing through outer cooling passages 126 corresponding to the outer passage sections 26 of the core 10 on either side of the lower boss 34, the lower boss 34 may have a length to width ratio of about 3:1 to about 10:1. In a particular embodiment, a length to width ratio of about 7:1 may be used. Although described as elliptical, the lower boss 34 may have any other suitable configuration.

Similarly, as shown in FIG. 5, in embodiments, the upper boss 36 may also have a substantially elliptical configuration. A channel 44 (see also FIGS. 3 and 7 (in phantom) and FIG. 6) diverges around a first end of the upper boss 36 and converges at a second end of the upper boss 36. To limit turbulence and pressure loss of air (represented by arrow B in FIG. 11) flowing through outer cooling passages 126 corresponding to the outer passage sections 26 of the core 10 on either side of the upper boss 36, the upper boss 36 may have a length to width ratio of about 3:1 to about 10:1. In a particular embodiment, a ratio of about 7:1 may be used. Although described as elliptical, the upper boss 36 may have any other suitable configuration.

According to embodiments, the protrusions of the center plenum sections 24 provide positional control without the use of the bumpers, eliminating holes formed from the use of bumpers that potentially allow cooling flow to communicate between cavities (e.g., between the center plenums 124 and outer cooling passages 126 (FIGS. 8-11)). Further, better control of the position of the center plenum sections 24 results in a more tightly controlled rib wall thickness without the use of the bumpers, allowing the turbine airfoil to use less cooling air in a more deterministic solution, thus increasing the performance and output of the gas turbine. A direct line of contact of the lower and upper bosses 34, 36 of the center plenum sections 24 to the inner surfaces 18, 20 of the lower and upper setter blocks 12, 14 is created allowing the position of the central plenum sections 24 to be controlled independently of the outer cooling sections 26.

It has been difficult and expensive to measure the thickness of an inner wall of a multiwall airfoil, often requiring MRI measurements. Such an inner wall 130 is depicted in FIG. 8.

According to embodiments, the thickness $T_1$ of the inner wall 130 of the multiwall airfoil 22 can be readily inferred, without requiring expensive and time consuming MRI measurements. For example, an outer wall 132 of the multiwall airfoil 22 can be measured (e.g., ultrasonically) at first and second points X, Y to determined thicknesses $T_2$ and $T_3$, respectively. Point X is adjacent an outer cooling passage 126, while point Y is adjacent a protrusion 134 of a center plenum 124 formed by (in this case) a lower boss 34 of a central plenum section 24 of the core 10 (FIG. 7). Since the depth $D_1$ of the outer cooling passage 126 and the depth $D_2$ of the protrusion 134 of the center plenum 124 are known from the dimensions of the corresponding outer passage section 26 and corresponding lower boss 34, respectively, of the core 10, the thickness $T_1$ of the inner wall 130 can be determined as: $T_1=(T_3+D_2)-(T_2+D_1)$. The thickness of the inner wall 130 may be determined in a similar manner at other points of the multiwall airfoil 22. Although this process has been described with regard to a protrusion 134 of a center plenum 124, the process can be extended to other portions of a multiwall airfoil 22 formed with or using a boss as described herein.

The use of bosses, such as those described above, may be extended to other portions of a core in the casting process of a multiwall airfoil. For example, as will be described below, one or more bosses may be used in a trailing edge cooling circuit located adjacent the trailing edge of the multiwall airfoil.

Figure 12:
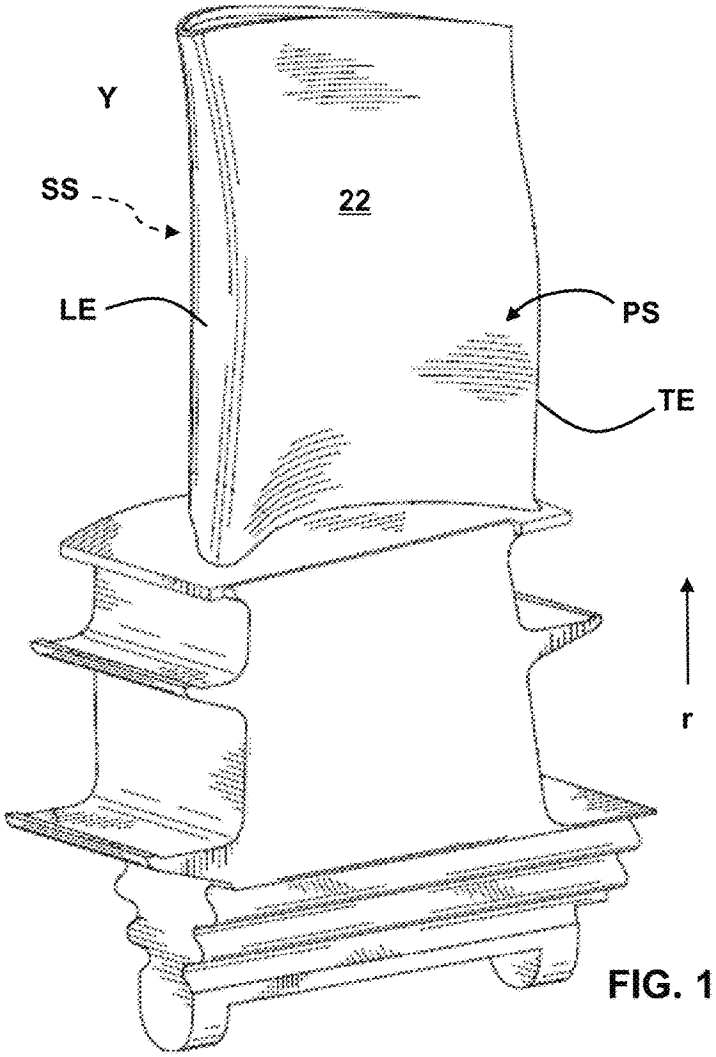
FIG. 12 is a perspective view of a multiwall airfoil according to embodiments.

A perspective view of the multiwall airfoil 22 is depicted in FIG. 12. As shown, the multiwall airfoil 22 includes a pressure side PS and an opposed suction side SS. The multiwall airfoil 22 further includes a leading edge LE between the pressure side PS and the suction side SS, as well as a trailing edge TE between the pressure side PS and the suction side SS on a side opposing the leading edge LE. Generally, the multiwall airfoil 22 includes a trailing edge cooling circuit including at least one trailing edge passage, adjacent the trailing edge TE.

Figure 14:
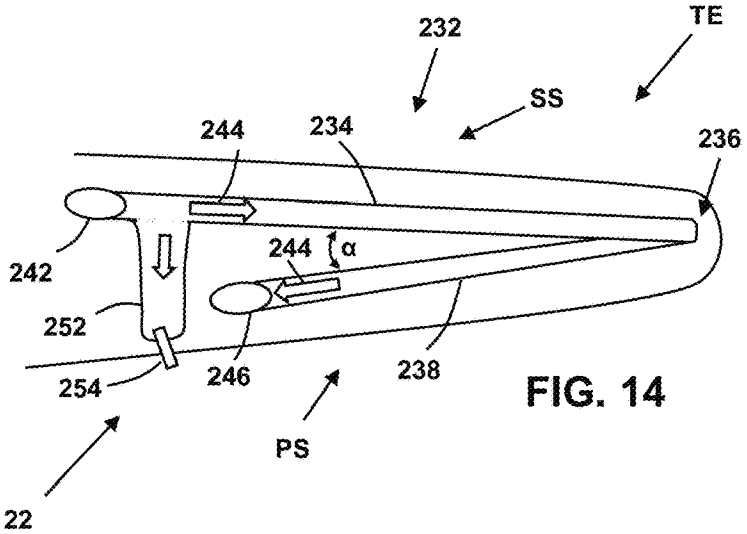
FIG. 14 is a top cross-sectional view of the trailing edge cooling circuit of FIG. 13 according to embodiments.
Figure 13:
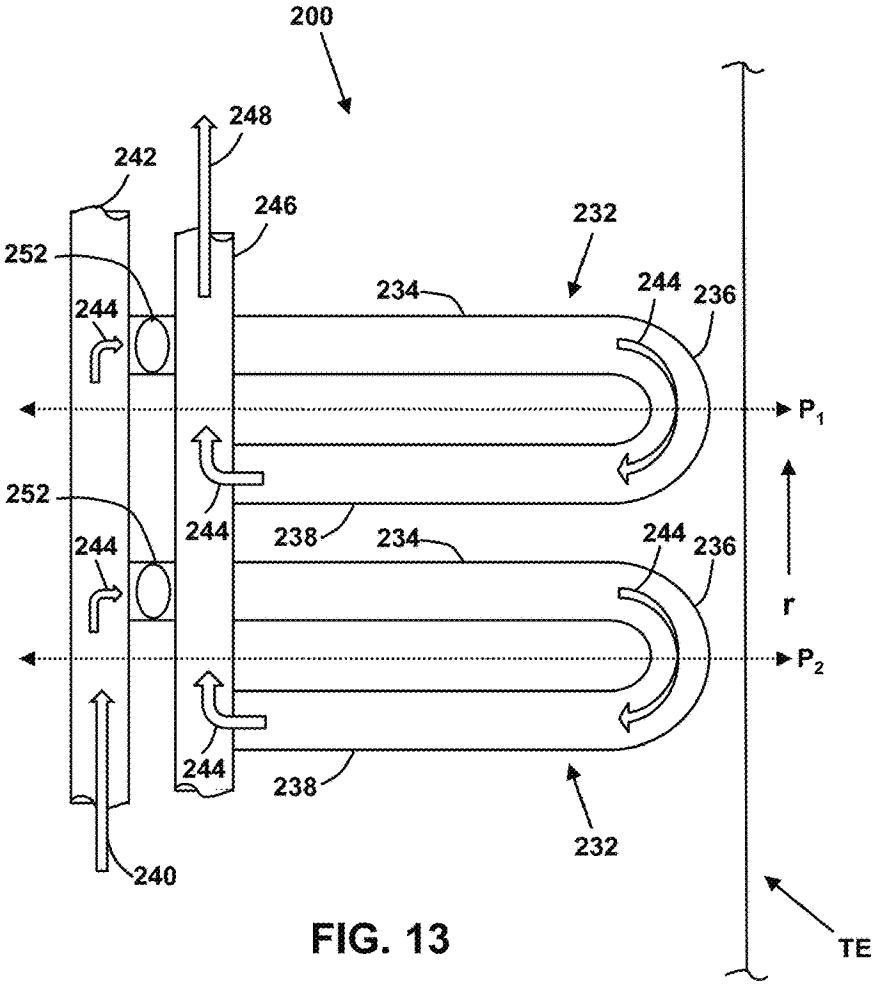
FIG. 13 is a side view of a portion of a trailing edge cooling circuit according to embodiments.

An example of a trailing edge cooling circuit 200 is depicted in FIGS. 13 and 14. The trailing edge cooling circuit 200 includes a plurality of radially spaced (i.e., along the "r" (radial) axis) cooling circuits 232 (only two are shown), each including an outward leg 234, a turn 236, and a return leg 238. The outward leg 234 extends axially toward the trailing edge TE of the multiwall airfoil 22. The return leg 238 extends axially toward the leading edge LE of the multiwall airfoil 22. The outward and return legs 234, 238 may follow the contour of the suction and pressure sides SS, PS of the multiwall airfoil 22. In embodiments, the trailing edge cooling circuit 200 may extend along an entire radial length of the trailing edge TE of the multiwall airfoil 22. In other embodiments, the trailing edge cooling circuit 200 may partially extend along one or more portions of the trailing edge TE of the multiwall airfoil 22.

In each cooling circuit 232, the outward leg 234 is radially offset along the "r" axis relative to the return leg 238 by the turn 236. To this extent, the turn 236 fluidly couples the outward leg 234 of the cooling circuit 232, which is disposed at a first radial plane $P_1$, to the return leg 238 of the cooling circuit 232, which is disposed in a second radial plane $P_2$, different from the first radial plane $P_1$. In the non-limiting embodiment shown in FIG. 13, for example, the outward leg 234 is positioned radially outward relative to the return leg 236 in each of the cooling circuits 232. In other embodiments, in one or more of the cooling circuits 232, the radial positioning of the outward leg 234 relative to the return leg 238 may be reversed such that the outward leg 234 is positioned radially inward relative to the return leg 236.

As shown in FIG. 14, in addition to a radial offset, the outward leg 234 may be circumferentially offset by the turn 236 at an angle $\alpha$ relative to the return leg 238. In this configuration, the outward leg 234 extends along the suction side SS of the multiwall airfoil 22, while the return leg 238 extends along the pressure side PS of the multiwall airfoil 22. In other embodiments, the outward leg 234 may extend along the pressure side PS of the multiwall airfoil 22, while the return leg 238 may extend along the suction side SS of the multiwall airfoil 22. The radial and circumferential offsets may vary, for example, based on geometric and heat capacity constraints on the trailing edge cooling circuit 200 and/or other factors. The circumferential offset may be the same for each cooling circuit 232 or may change based, for example, on the radial position of the cooling circuit 232 in the trailing edge TE of the multiwall airfoil 22.

A flow of cooling air 240 (or other suitable coolant), generated for example by a compressor of a gas turbine system, flows into the trailing edge cooling circuit 200 via at least one coolant feed 242 (e.g., cool air feed 242). In general, any suitable type of coolant may be used. Each cool air feed 242 may be provided using any other suitable source of cooling air in the multiwall airfoil 22. At each cooling circuit 232, a portion 244 of the flow of cooling air 240 passes into the outward leg 234 of the cooling circuit 232 and flows towards the turn 236. The flow of cooling air 244 is redirected (e.g., reversed) by the turn 236 of the cooling circuit 232 and flows into the return leg 238 of the cooling circuit 232. The portion 244 of the flow of cooling air 240 passing into each outward leg 234 may be the same for each cooling circuit 232, or may be different for different sets (i.e., one or more) of the cooling circuits 232.

According to embodiments, the flows of cooling air 244 from a plurality of the cooling circuits 232 of the trailing edge cooling circuit 200 flow out of the return legs 238 of the cooling circuits 232 into a collection passage 246. A single collection passage 246 may be provided, however multiple collection passages 246 may also be utilized. Although shown as flowing radially outward through the collection passage 246 in FIG. 13, the "used" cooling air may instead flow radially inward through the collection passage 246.

The cooling air 248, or a portion thereof, flowing into and through the collection passage 246 may be directed (e.g. using one or more passages within the multiwall airfoil 22) to one or more additional cooling circuits of the multiwall airfoil 22. To this extent, at least some of the remaining heat capacity of the cooling air 248 is exploited for cooling purposes instead of being inefficiently expelled from the trailing edge TE of the multiwall airfoil 22.

Figure 15:
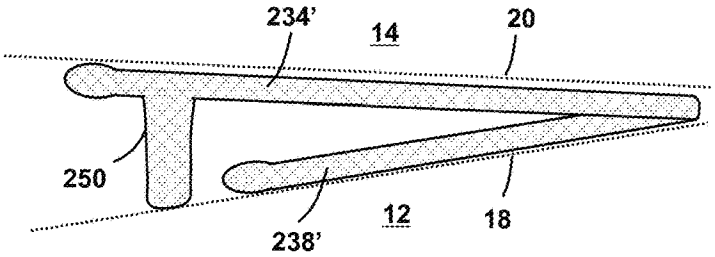
FIG. 15 is a top cross-sectional view of a portion of a core according to embodiments.

During the casting process, as depicted, for example, in FIG. 15, the core section 238' corresponding to the return leg 238 is supported by the inner surface 18 of the lower setter block 12. According to embodiments, the core section 234' corresponding to the outward leg 234 is supported by a boss 250 that extends from the core section 234' toward and against the inner surface 18 of the lower setter block 12. Use of the boss 250 ensures that the core section 234' corresponding to the outward leg 234 is properly supported and positioned during the firing process.

The boss 250 forms a passage 252 in the resultant casting, as shown in FIGS. 13 and 14. In some cases, the passage 252 may be a non-functioning portion of the trailing edge cooling circuit 200. In other cases, however, the passage 252 may be fluidly coupled to film holes 254, for providing cooling film to a portion (e.g., pressure side PS) of the trailing edge TE of the multiwall airfoil. In general, the passage 252 may be fluidly coupled to other cooling circuits in the trailing edge TE or other portions of the multiwall airfoil 22.

Figure 16:
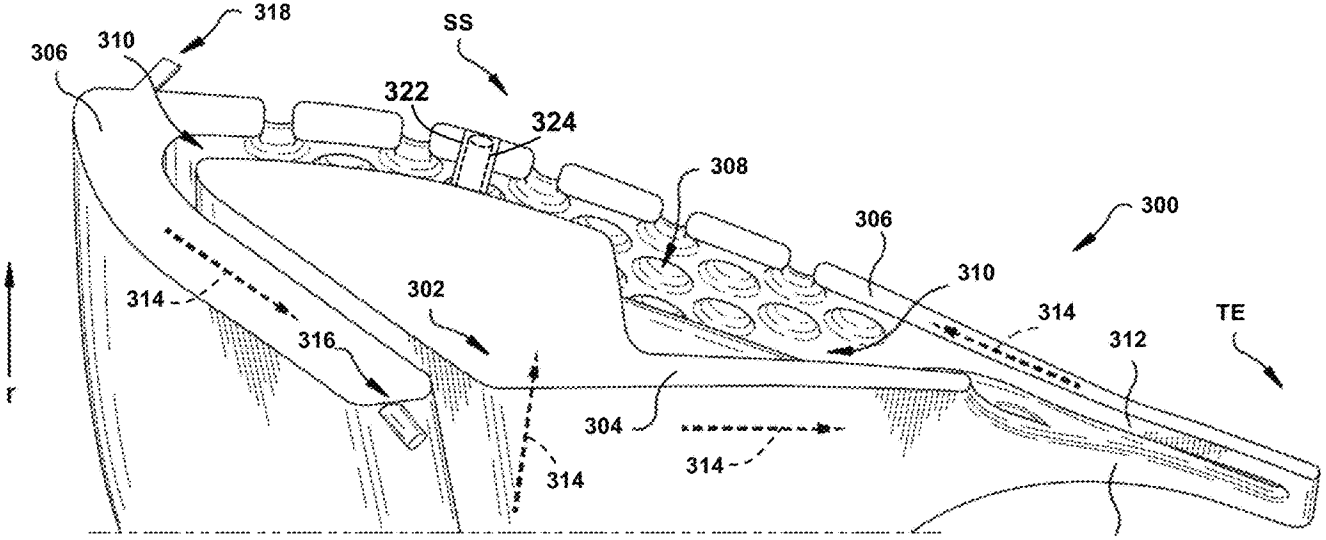
FIG. 16 is a perspective view of a portion of a trailing edge cooling circuit according to embodiments.

Another embodiment of a trailing edge cooling circuit 300 is depicted in FIG. 16. As shown, the trailing edge cooling circuit 300 includes a first passage 302 extending radially outward toward a tip of the multiwall airfoil 22 along the pressure side PS, a second passage 304 extending from the first passage 302 toward the trailing edge TE, and a third passage 306 extending from the trailing edge TE along the suction side SS. In various embodiments, the trailing edge cooling circuit 300 is configured to direct a flow of cooling air 314 (or other suitable coolant), from the first passage 302, through the second passage 304, and into the third passage 306. As described herein, each passage 302, 304, 306 may have additional flow modification features, and portions of the cooling air 314 may be redirected or otherwise employed while flowing through or between the passages 302, 304, 306.

The trailing edge circuit 300 may further include a suction side heat transfer element 308 within the third passage 306 for modifying (e.g., disrupting) the flow of cooling air through the third passage 306. In various embodiments, the suction side heat transfer elements 308 can include one or more pinbank(s), turbulator(s) (e.g., trip-strips), hump(s) or bump(s).

As shown in FIG. 16, according to various embodiments, the third passage 306 is fluidly connected with the first passage 302 via the second passage 304, such that the second passage 304 and third passage 306 collectively wrap around an interior region 310 within the trailing edge TE. In various embodiments, the trailing edge cooling circuit 300 also includes a set of fluid channels 312 extending through the trailing edge TE for permitting the flow of cooling air. The fluid channels 312 allow cooling air to flow there-through, and also allow the cooling air to redirect back away from trailing edge TE toward a leading edge LE, and in some cases, the first passage 302.

A supply of cooling air 314 (or other suitable coolant), generated for example by a compressor of a gas turbine system, is fed to the trailing edge cooling circuit 300 (e.g., via at least one cooling air feed). The cooling air 314 is fed radially outward into the first section 302 along the pressure side PS of the multiwall airfoil 22. As the cooling air 314 moves radially along the first section 302, it flows aftward to the second passage 304 and toward the trailing edge fluid channels 312. As the multiwall airfoil 22 does not include trailing edge outlet apertures, the cooling air 314 flowing through the fluid channels 312 reaches trailing edge TE and reverses course back into third passage 306 along the suction side SS of the multiwall airfoil 22. The cooling air 314, as it flows through third passage 306, may be recycled for other heat transfer purposes, or in some cases, may be ejected, e.g., for film cooling, at one or more pressure side film holes 316 or suction side film holes 318. It is understood that the cooling air 314 may generally flow in this manner as it wraps around the interior (e.g., interior space 310) of the multiwall airfoil 22 in a radial direction.

Figure 17:
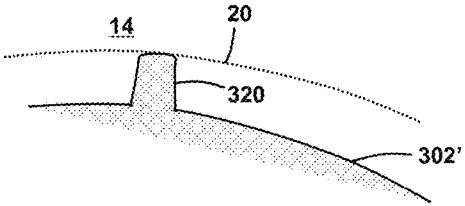
FIG. 17 is a top view of a portion of a core according to embodiments.

During the casting process, the core section 302' (FIG. 17) corresponding to the first passage 302 may not be fully supported within the setter blocks 12, 14 during firing. According to embodiments, the core section 302' may be provided with a boss 320 that is configured to engage an inner surface of an upper setter block (e.g., inner surface 20 of upper setter block 14, FIG. 2) during firing. This functionality is similar to that provided by the upper boss 36 depicted in FIG. 5. Use of such a boss 320 ensures that the core section 302' corresponding to the first passage 302 is properly supported and positioned during the firing process.

Figure 18:
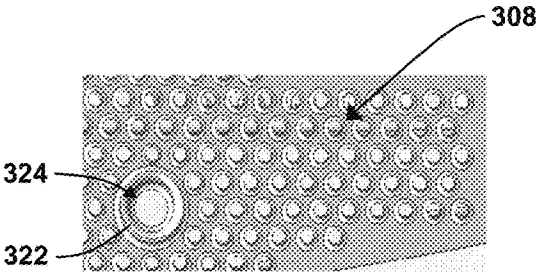
FIG. 18 depicts a portion of the trailing edge cooling circuit of FIG. 16 according to embodiments.

Use of the boss 320 results in a hollow structure 322 in the resultant casting (FIG. 16). In embodiments, as shown in FIGS. 16 and 18, the hollow structure 322 may be placed as part of the suction side heat transfer element 308. The passage 324 through the hollow structure 322 may also be fluidly coupled to the first passage 302 to provide film cooling to the suction side SS of the multiwall airfoil 22.

Figure 19:
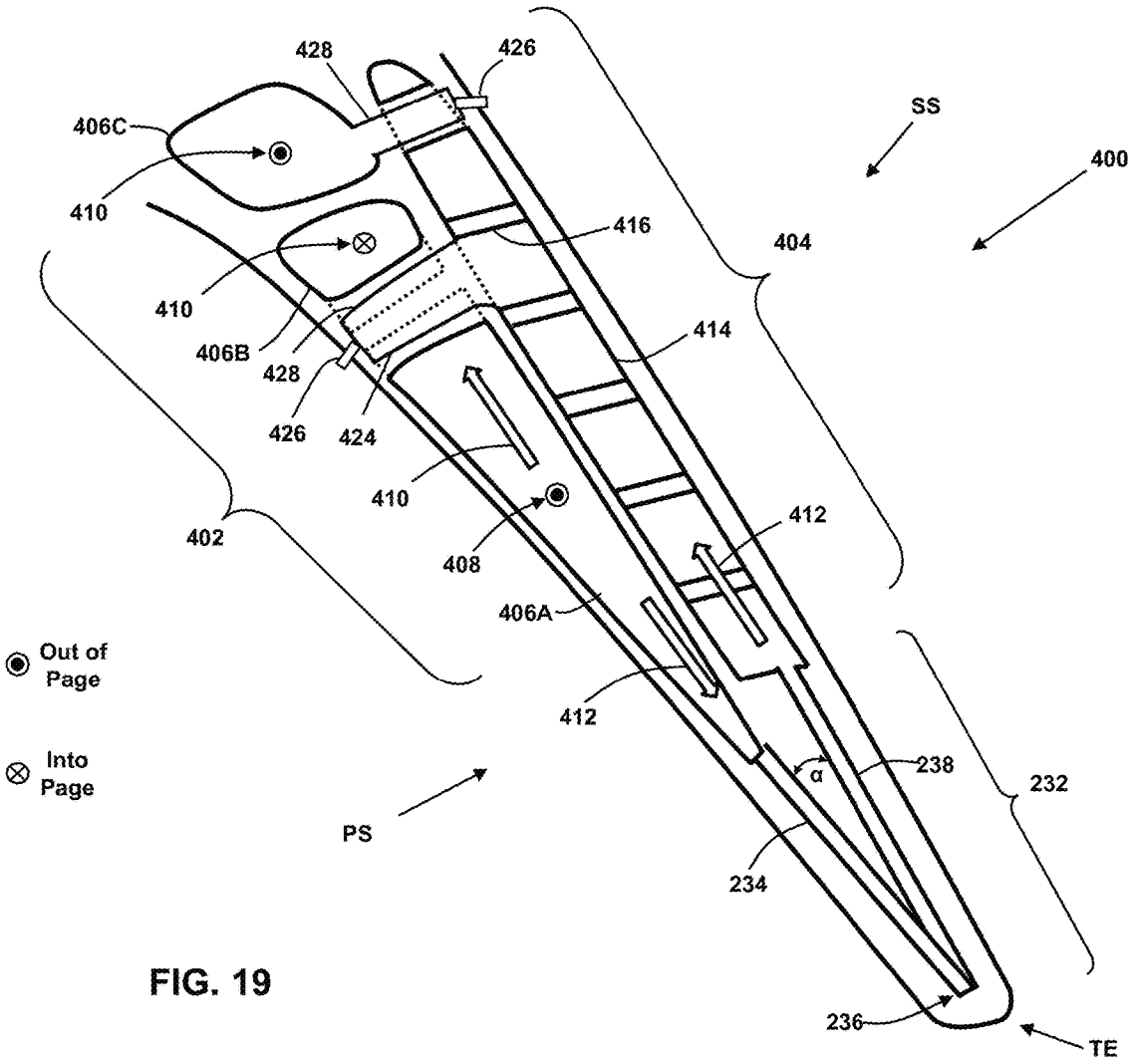
FIG. 19 is a top cross-sectional view of a trailing edge cooling system according to embodiments.

Another embodiment of a trailing edge cooling circuit 400 is depicted in FIG. 19. In this embodiment, the trailing edge cooling circuit 400 includes a cooling circuit 232, a pressure side PS serpentine cooling circuit 402, and a suction side SS cooling circuit 404. As detailed above, the cooling circuit 232 includes an outward leg 234, a turn 236, and a return leg 238.

The PS serpentine cooling circuit 402 includes a plurality of radial extending passages (406A, 406B, 406C in this example). A flow of cooling air 408 flows radially outward (e.g., along the r axis (FIG. 12)) through the passage 406A. A first portion 410 of the cooling air 408 is directed into the passage 406B, and flows radially inward. The first portion 410 of the cooling air 408 is subsequently directed into, and flows radially outward through, the passage 406C. Although not shown, the first portion 410 of the cooling air 408 may flow from the passage 406C into another cooling circuit (e.g., to provide film cooling).

A second portion 412 of the flow of cooling air 408 passes into the outward leg 234 of the cooling circuit 232, and is redirected by the turn 236 into the return leg 238 of the cooling circuit 232. The second portion 412 of the flow of cooling air 408 passes out of the return leg 238 into a suction side SS passage 414. A pinbank 416 is provided within the suction side SS passage 414. Although not shown, the second portion 412 of the cooling air 408 may flow from the suction side SS passage 414 into/through another cooling circuit (e.g., to provide film cooling).

Figure 20:
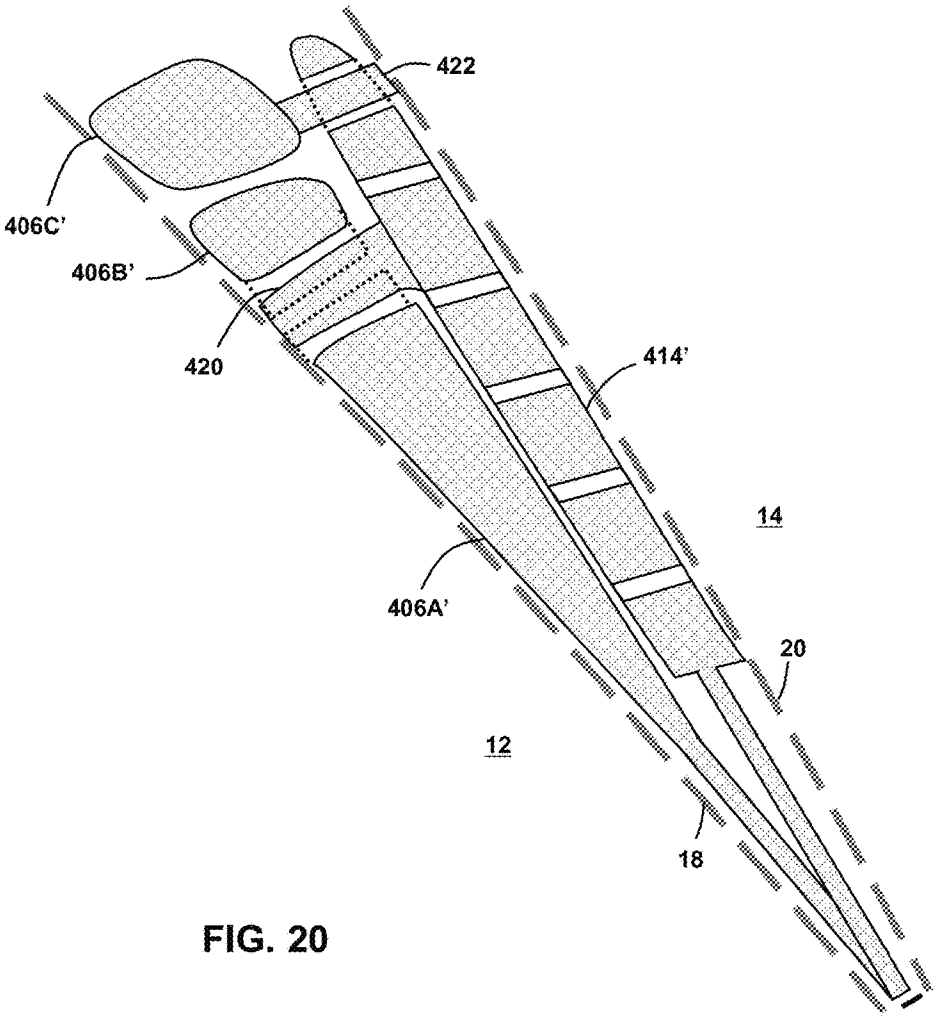
FIG. 20 is a top view of a portion of a core according to embodiments.

During the casting process, the core section 414' (FIG. 20) corresponding to the suction side SS passage 414 may not be fully supported within the setter blocks 12, 14 during firing. According to embodiments, as shown in FIG. 20, the core section 414' may be provided with a boss 420 that is configured to engage an inner surface of a lower setter block (e.g., inner surface 18 of lower setter block 12, FIG. 2) during firing. This functionality is similar to that provided by the lower boss 34 depicted in FIG. 5. Use of such a boss 420 ensures that the core section 414' corresponding to the suction side SS passage 414 is properly supported and positioned during the firing process. Use of the boss 420 results in a passage 424 being formed in the resultant casting. As with the passage 252 (FIG. 14), the passage 424 may be a non-functioning portion of the trailing edge cooling circuit 400, or may be fluidly coupled to other cooling circuits in the trailing edge TE or other portions of the multiwall airfoil 22. For example, the passage 424 may be fluidly coupled to film holes 426, for providing cooling film to a portion (e.g., pressure side PS) of the trailing edge TE of the multiwall airfoil.

As depicted in FIG. 20, the boss 420 extends between the core sections 406A', 406B', corresponding to the passages 406A, 406B (FIG. 19), from the core section 414' to the inner surface 18 of lower setter block 12. In other embodiments, the boss 420 may extend between the core sections 406B', 406C', corresponding to the passages 406B, 406C (FIG. 19), from the core section 414' to the inner surface 18 of lower setter block 12, and/or the like. In either case, the boss 240 is integrated between a pair of the passages (e.g., 406A, 406B, 406C, FIG. 19) along the pressure side PS of the multiwall airfoil 22. In general, the boss 420 may extend from the core section 414' to the inner surface 18 of lower setter block 12 between a set of adjacent core sections 406. Multiple bosses 420 may also be used.

As further depicted in FIG. 20, the core section 406C' corresponding to the passage 406C (FIG. 19) may also not be fully supported within the setter blocks 12, 14 during firing. According to embodiments, the core section 406C' may be provided with a boss 422 that is configured to engage an inner surface of an upper setter block (e.g., inner surface 20 of upper setter block 14, FIG. 2), and extend through the core section 414', during firing. Use the boss 422 ensures that the core section 406C' corresponding to the passage 406C is properly supported and positioned during the firing process. Similar bosses may be provided for each of the core sections 406A', 406B' corresponding to the passages 406A, 406B, respectively. Advantageously, as shown in FIG. 19, the resultant passage 428 formed due to the boss 422 in the casting may be incorporated into the pinbank 416 within the suction side SS passage 414, Further, the passage 428 may be fluidly coupled to the passage 406C to provide film cooling to the suction side SS through film holes 426.

In various embodiments, components described as being "coupled" to one another can be joined along one or more interfaces. In some embodiments, these interfaces can include junctions between distinct components, and in other cases, these interfaces can include a solidly and/or integrally formed interconnection. That is, in some cases, components that are "coupled" to one another can be simultaneously formed to define a single continuous member. However, in other embodiments, these coupled components can be formed as separate members and be subsequently joined through known processes (e.g., fastening, ultrasonic welding, bonding).

When an element or layer is referred to as being "on", "engaged to", "connected to" or "coupled to" another element, it may be directly on, engaged, connected or coupled to the other element, or intervening elements may be present. In contrast, when an element is referred to as being "directly on," "directly engaged to", "directly connected to" or "directly coupled to" another element, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A core for an airfoil casting, comprising:

a cantilevered core section forming a leg of a trailing edge cooling circuit of an airfoil portion of the airfoil casting, the leg of the trailing edge cooling circuit extending along a first side of the airfoil portion of the airfoil casting;

a plurality of outer core sections forming an additional cooling circuit in the airfoil portion of the airfoil casting, the additional cooling circuit extending along a second, opposing side of the airfoil portion of the airfoil casting; and a boss extending from an inner surface of the cantilevered core section to an outer profile of the core and between a pair of the plurality of outer core sections, the boss forming a passage fluidly coupled to an exterior of the second side of the airfoil portion of the airfoil casting.

2. The core according to claim 1, wherein the core is disposed between a first setter block and a second setter block, and wherein the boss controls a position of the cantilevered core section in a cavity formed by the first setter block and second setter block during a firing process, and wherein the boss prevents movement of the cantilevered core section in the cavity during the firing process.

3. The core according to claim 1, wherein the airfoil casting comprises a multiwall airfoil casting.

4. The core according to claim 1, wherein the boss forms a portion of a heat transfer element in the airfoil portion of the airfoil casting.

5. The core according to claim 1, wherein the boss forms a portion of a pinbank in the airfoil portion of the airfoil casting.

6. A core for a multiwall airfoil casting, comprising:

a cantilevered core section forming a leg of a trailing edge cooling circuit of an airfoil portion of the multiwall airfoil casting, the leg of the trailing edge cooling circuit extending along a first side of the airfoil portion of the multiwall airfoil casting;

a plurality of outer core sections forming an additional cooling circuit in the airfoil portion of the multiwall airfoil casting, the additional cooling circuit extending along a second, opposing side of the airfoil portion of the multiwall airfoil casting; and a boss extending from an inner surface of the cantilevered core section to an outer profile of the core and between a pair of the plurality of outer core sections for controlling a position of the cantilevered core section during a firing process, the boss forming a passage fluidly coupled to an exterior of the second side of the airfoil portion of the multiwall airfoil casting.

7. The core according to claim 6, wherein the boss forms a portion of a heat transfer element in the airfoil portion of the multiwall airfoil casting.

8. The core according to claim 7, wherein the heat transfer element comprises a pinbank.

* * * * *